US008795139B2

(12) United States Patent
Zhang et al.

(10) Patent No.: US 8,795,139 B2
(45) Date of Patent: Aug. 5, 2014

(54) LOWER-LIMB OFF-AXIS TRAINING APPARATUS AND SYSTEM

(75) Inventors: Li-Qun Zhang, Wilmette, IL (US); Yupeng Ren, Chicago, IL (US)

(73) Assignee: Rehabtek LLC, Wilmette, IL (US)

( * ) Notice: Subject to any disclaimer, the term of this patent is extended or adjusted under 35 U.S.C. 154(b) by 26 days.

(21) Appl. No.: 12/650,517

(22) Filed: Dec. 30, 2009

(65) Prior Publication Data

US 2012/0172176 A1 Jul. 5, 2012

Related U.S. Application Data

(60) Provisional application No. 61/141,243, filed on Dec. 30, 2008.

(51) Int. Cl.
*A63B 24/00* (2006.01)

(52) U.S. Cl.
USPC ..... 482/52; 482/8; 482/51; 601/27

(58) Field of Classification Search
USPC ..... 482/51–53, 57, 79, 80, 93, 136; 601/27
See application file for complete search history.

(56) References Cited

U.S. PATENT DOCUMENTS 7,828,698 B2 * 11/2010 Rodgers, Jr. ..... 482/52
7,909,740 B2 * 3/2011 Dalebout et al. ..... 482/52
8,323,156 B2 * 12/2012 Ozawa et al. ..... 482/95

* cited by examiner

*Primary Examiner* — Glenn Richman

(57) ABSTRACT

This invention provides a lower-limb off-axis movement training apparatus, which is mounted on the movement part of a sagittal plane exercise machine and allows the user to perform off-axis movement training during sagittal plane functional movements. The said apparatus for the lower limb off-axis training consists of a base, an off-axis movement generating part mounted on the base, and a foot container supported by the off-axis movement generating part. The said off-axis movement generating part comprising at least one of the following two: (1) off-axis pivoting generating part, which generates the pivoting movement of the foot container; (2) off-axis sliding generating part, which generates the sliding movement of the foot container. A feedback training system including the said training apparatus is provided. While the user performs sagittal plane movements of the lower limbs, the said system provides off-axis movement training integrated with the sagittal plane movements. The invented off-axis training apparatus and system can be used to help human subjects improve off-axis and sagittal plane neuromuscular control, reduce the incidence of lower limb injuries and facilitate post-injury rehabilitation.

10 Claims, 9 Drawing Sheets

LOWER-LIMB OFF-AXIS TRAINING APPARATUS AND SYSTEM

FIELD OF INVENTION

The present invention relates to the field of exercise training and musculoskeletal injury prevention and post-injury rehabilitation.

BACKGROUND OF INVENTION

Musculoskeletal injuries of the lower limbs are associated with the strenuous sports and recreational activities. The knee is the most often injured region of the body, with the ACL as the most frequently injured structure of the knee (Lauder et al., *Am J Prev. Med.,* 18: 118-128, 2000). Approximately 80,000 to 250,000 ACL tears occur annually in the U.S. with an estimated cost for the injuries of almost one billion dollars per year (Griffin et al. *Am J Sports Med.* 34, 1512-32). The highest incidence is in individuals 15 to 25 years old who participate in pivoting sports (Griffin et al., *J Am Acad Orthop Surg.* 8, 141-150, 2000). Considering that the lower limbs are free to move in the sagittal plane (e.g., knee flexion/extension, ankle dorsi-/plantar flexion), musculoskeletal injuries generally do not occur in sagittal plane movements. On the other hand, joint motion about the minor axes (e.g., knee valgus/varus (synonymous with abduction/adduction), tibial rotation, ankle inversion/eversion and internal/external rotation) is much more limited and musculoskeletal injuries are usually associated with excessive loading/movement about the minor axes (or called off-axes). The ACL is most commonly injured in pivoting and valgus activities that are inherent to sports and high demanding activities, for example.

It is therefore critical to improve neuromuscular control of off-axis motions (e.g., tibial rotation/valgus at the knee) in order to reduce/prevent musculoskeletal injuries and to facilitate post injury rehabilitation. However, existing exercise equipment (e.g., elliptical machine, treadmill, stair climber, stepper, and leg press machine) generally focuses on the sagittal plane movement. Due to the structural limitation, the user simply cannot do the lower extremely control training in the off-axis direction (such as knee valgus/varus, or internal/external rotation, tibial rotation and ankle inversion/eversion). For another solution to the off-axis training, for example, off-axis movement training in a seated posture such as tibial rotation or valgus in isolation is unlikely to be practical and effective since there is no accordingly movement involved in sagittal plane.

SUMMARY OF INVENTION

A training program that addresses the specific issue of off-axis movement control during sagittal plane stepping/running functional movements is helpful in preventing musculoskeletal injuries of the lower limbs in strenuous and training and in real sports activities and in post-injury rehabilitation. This invention describes a novel lower limb training apparatus and feedback training system which is based on injury mechanisms that are closed related to excessive off-axis movements and loadings.

The said lower limb off-axis training apparatus is mounted on the movement part of a sagittal plane exercise machine and allows the user to perform lower limb off-axis training during sagittal plane functionally relevant movements. The said apparatus for the lower limb off-axis training consists of a supporting base which can move in the sagittal plane on left and right sides, an off-axis movement generating part on the base on each side, and a foot container supported by the off-axis movement generating part. The said off-axis movement generating part at least includes one of the following two: (1) off-axis pivoting movement generating part, which generates the pivoting movement of the foot container and the corresponding force; (2) off-axis sliding movement generating part, which generates sliding movement of the foot container and the corresponding force. In other words, the off-axis movement generating part can includes a pivoting movement generating part or a sliding movement generating part alone on each side; or it can include both the pivoting and sliding movement generating parts.

In one way, the off-axis pivoting and/or sliding movement generating parts allow the user's lower limbs to control and drive the foot container and the off-axis movement generating parts follow the user's movement. Under this condition, the user applies an active force and the off-axis movement generating part generates resistant force accordingly. In another way, the off-axis movement generating part can also generate and control a pivoting or sliding force as an active force provider and the user perform certain movements according to the force his or her lower limbs sense.

As a further development, the off-axis feedback training system includes an exercise machine with functional movement in the sagittal plane, the said apparatus for the off-axis movement training which is mounted on the said exercise machine, a recording device used to record the user's lower limbs movement information and a displaying device used to display the recorded movement as the feedback information.

The off-axis training apparatus and feedback system can help people improve lower limb neuromuscular control about the off-axes (e.g., external/internal tibial rotation and valgus/varus at the knee, inversion/eversion and external/internal rotations at the ankle, and slidings in mediolateral, anteroposterior directions in general, and their combined motions) and reduce the risk of ACL and other lower limb musculoskeletal injuries. Practically, an isolated tibial pivoting or frontal plane valgus/varus exercise against resistance in a seated posture, for example, is not closely related to functional weight-bearing activities and may not provide effective training.

Therefore, in this invention we proposed a unique lower limb training method: off-axis training integrated with sagittal movement, which makes the training more practical and potentially more effective. In practical applications, the off-axis training (e.g., pivoting/sliding) mechanisms can be combined with various existing sagittal plane exercise/training machines (e.g., elliptical machines, stair climbers, stair steppers, exercise bicycles, and leg press machines) to perform off-axis training of the lower limb flexibly.

BRIEF DESCRIPTION OF THE DRAWINGS

FIG. 5C is a perspective view of the lower limb off-axis training apparatus, based on the apparatus shown in FIG. 5A, using a turning knob to adjust the pivoting resistance.

FIG. 5D Various spring groups used to change the stiffness to off-axis movement.

DETAILED DESCRIPTION OF THE INVENTION

Definition of Axes and Fundamental Planes of the Human Body

The novel and unique structure of this invention is closely related to the degrees of freedom of human limb movement. In order to more clearly and accurately describe the structures and functions of the off-axis movement apparatus, the relevant planes and axes need to be defined as follows:

Human movements are described in three dimensions based on a series of planes and axes. The human body movements can be described using three orthogonal axes, vertical axis (Z), sagittal axis (Y) and the frontal axis (X). There are three orthogonal planes of motions: the sagittal plane (P1), the frontal plane (P2) and the transverse (horizontal) plane (P3) (FIG. 1).

Figure 1A:
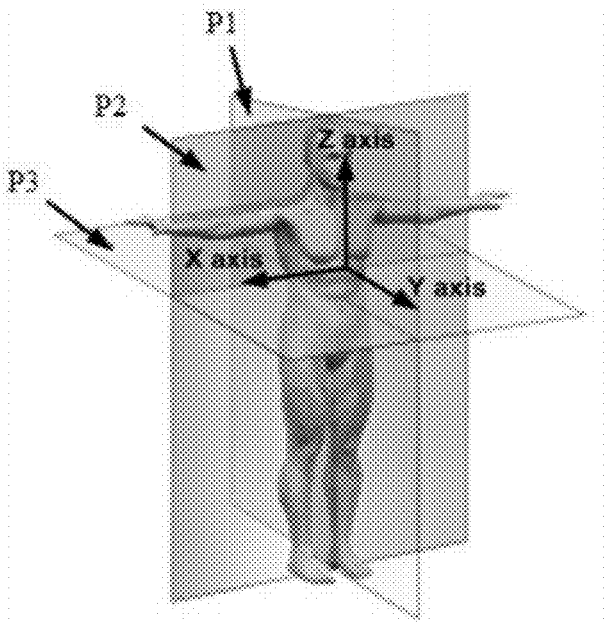
FIG. 1A Definition of the axes and fundamental planes of the human body.

The definitions of the human body plane and X-Y-Z coordinate system are as follows:

Define the human body fundamental planes, as FIG. 1A:

(1) The sagittal plane P1: perpendicular to the ground, which separates left from right of the human body. The mid-sagittal plane is the specific sagittal plane that is exactly in the middle of the human body.

(2) The frontal plane P2: perpendicular to the ground, which separates the anterior from the posterior of the human body, the front from the back, the ventral from the dorsal.

(3) The transverse plane P3: parallel to the ground, which (in humans) separates the superior from the inferior, or put another way, the head from the feet.

Define the human body orthogonal axes, as FIG. 1A:

(1) The frontal axis X: going from form left to right of the human body and perpendicular to the sagittal plane. The said orientation is defined as the positive direction of X axis.

(2) The sagittal axis Y: going from posterior to anterior of the human body and perpendicular to the frontal plane. The said orientation is defined as the positive direction of Y axis.

(3) The vertical axis Z: going from form inferior to superior of the human body and perpendicular to the transverse plane. The said orientation is defined as the positive direction of Z axis.

Figure 1B:
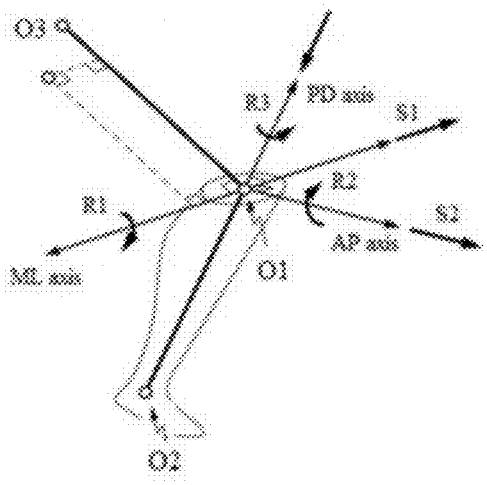
FIG. 1B Definition of the local coordinate system of knee joint movement.

In order to describe the correct off-axis motion of the knee and ankle joint more clearly, we further define the local coordinate system of knee joint movement. As shown in FIG. 1B, O1 is the rotation center of the right knee, O2 is the rotation center of the right ankle, and O3 is the rotation center of the right hip.

(1) Internal rotation/external rotation movement axis (PD axis): along the longitudinal axis of tibial rotation axis, the vector from ankle joint to knee joint is defined as the positive direction. Tibia and foot rotation along this axis is defined as the internal/external rotation movement R3 of the lower limb.

(2) Varus/valgus rotation axis (AP axis): going through the knee joint, the vector from the posterior to anterior of the knee joint is defined as positive direction. Tibia and foot rotation along this axis is defined as the varus/valgus rotation movement R2 of the lower limb. Tibia sliding along the axis is defined as the forward and backward sliding movement S2 of the lower limb.

(3) Flexion/extension rotation axis (ML axis): going through the knee joint, perpendicular to the sagittal plane, the vector from the medial point to the lateral is defined as the positive direction. Tibia and foot along the axis of rotation is defined as the flexion/extension movements R1 of the lower limb. Lower limb sliding along this axis is defined as the medial-lateral sliding S1 of the lower limb.

To clearly describe the Claims as well as the invention content, we define:

(1) Sagittal movement of the lower limb:

Lower limb movement in the plane which is in parallel to the sagittal plane P1 and the rotation axis at hip, knee and ankle joint is parallel to the ML axis, such as knee flexion and extension and ankle dorsi- and plantar flexion.

(2) Off-axis movements of the lower limb:

Lower limb rotation movements about the PD axis or AP axis. such as knee varus/valgus, tibial internal rotation/external rotation, ankle inversion/eversion and ankle internal/external rotation. Sliding movements of the foot along the ML axis is closely related to knee varus/valgus movement.

Lower Limbs Off-Axis Movement Training Apparatus

This lower-limb off-axis training apparatus provides a series of combined lower limb off-axis movements (pivoting and sliding). It can be mounted on various kinds of exercise machines which only provide the lower limb sagittal functional movement. The key feature of the combined off-axis training apparatus is to provide the lower limbs with combined intensive training about the off-axes during the sagittal plane large movement. This off-axis apparatus can be combined with a variety of sagittal plane lower and upper limb movement training machines, such as elliptical machines, stair climbers, stair steppers, exercise bicycles, and leg press machines. The following is a brief list of application examples of the off-axis pivoting mechanisms combined with an elliptical machine.

Figure 2A:
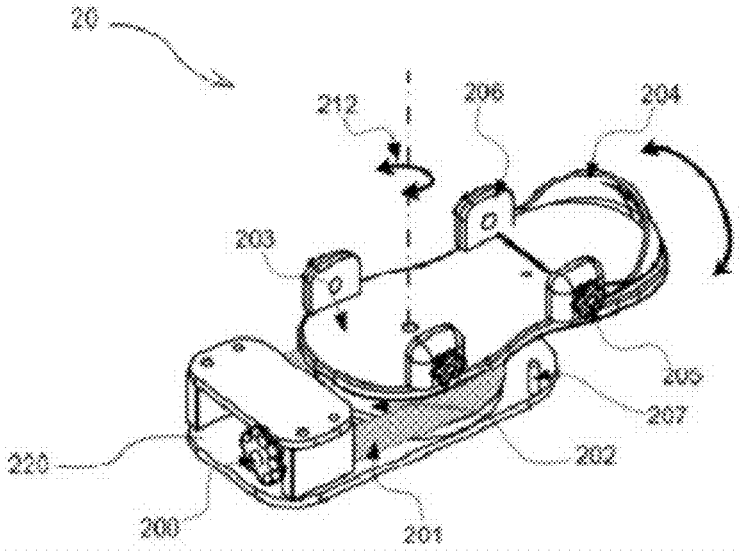
FIG. 2A is a perspective view of the 1st mechanical structure example of the lower limb off-axis training apparatus
Figure 2B:
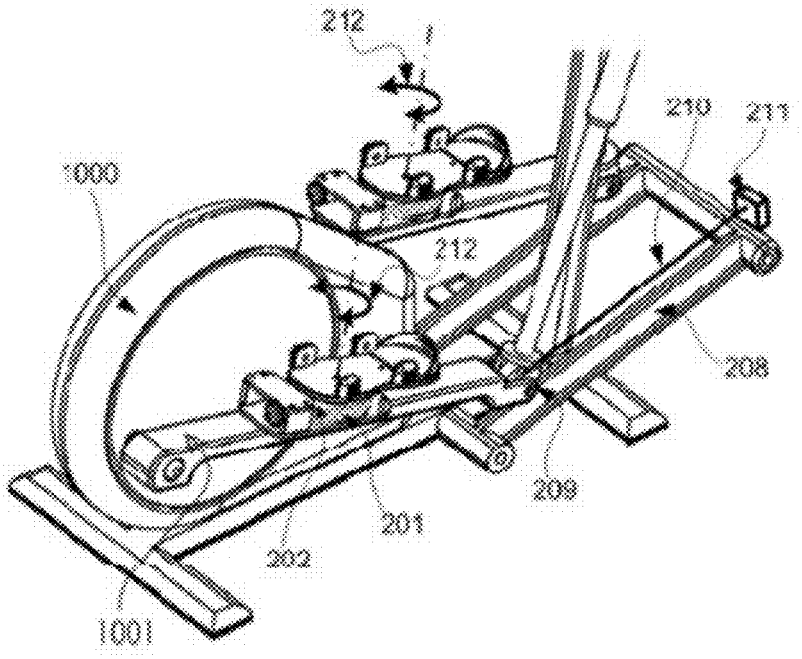
FIG. 2B is a perspective view of an elliptical machine with the off-axis apparatus shown in FIG. 2A FIG. 3 An example of combined off-axis and sagittal training mechanism implemented with the elliptical machine shown in FIG. 2B.

The 1st Functional Structure of the Off-Axis Training Apparatus:

FIG. 2A and FIG. 2B illustrate a lower limbs off-axis training apparatus 20 according to the first implementation case of this invention, which can perform the off-axis pivoting movement about the PD axis.

Mounted on the movement part 1001 of an elliptical machine 1000, the lower limbs off-axis training apparatus 20 according to the first implementation case of this invention replaces the traditional footplate in elliptical machine 1000.

Through the pivoting mechanism combined with elliptical machine training, 20 can implement the controlled tibial rotation during the large and functionally relevant movements (e.g., stepping/running) in the sagittal plane.

This training apparatus 20 consists of a base 220, which is mounted on the movement part 1001. The user stands on each of the pivoting footplate 203 of the training apparatus 20, with the help of pivoting disk 202, the feet are free to rotate in tibial rotation (about the PD axis 212). The user's shoes are mounted to the rotating footplate 203 through a toe strap 204 and medial and lateral shoe blockers 206 (or use a mechanism like a snowboard binding mounted on the rotating disk), when the user stand on the footplate 203, the toe strap 204 can fix the head of the shoe, and then by turning four knobs 205, the medial and lateral shoe blockers 206 can make the lateral of the shoes tight clipped. This structure has the function to make the shoe not only are tightly fixed to the footplate 203 and also can free rotated together with the rotation disk 202. In needed, the shoe can get off the footplate 203 conveniently (FIG. 2A and FIG. 2B) to avoid accidental injury of lower limbs.

The rotation disk of both sides can either freely rotate or rotate under the friction condition (FIG. 2A). The friction between the pivoting disk and the belt during rotation can be adjusted from zero which means no friction (free rotation) to large enough to lock the rotation disk 202. The apparatus with locked rotation disk is equivalent to a regular elliptical machine. As shown in FIG. 2A, the user turning the knob 200 clockwise to make the inside screw rotation, which drives the backward slide of the nut; and the nut is fixed with one end of the belt 201, thereby tension belt 201 backward and increase the friction between the belt 201 and rotation disk 202 has been increased. If the user counter-clockwise rotates knob 200, then belt 201 gradually becomes loose, and the friction between belt 201 and the rotation disk 202 will be reduced. With this belt tensioning mechanism, user can achieve the resistance adjustment of the off-axis training by turning the knob and control the tightness of the belt 201's wrapping on the rotation disk 202 (FIG. 2A). In addition, by releasing the belt 201, the footplate 203 and rotation disk 202 can free rotate. The user needs to deal with the instability during the sagittal plane movements and thus improve off-axis neuromuscular control ability.

There is a safety block 207 used to make sure no further rotation when the rotation disk 202 rotates to its limit, this safety block will prevent further rotation of footplate 203 to insure movement comfort and safety.

Figure 3:
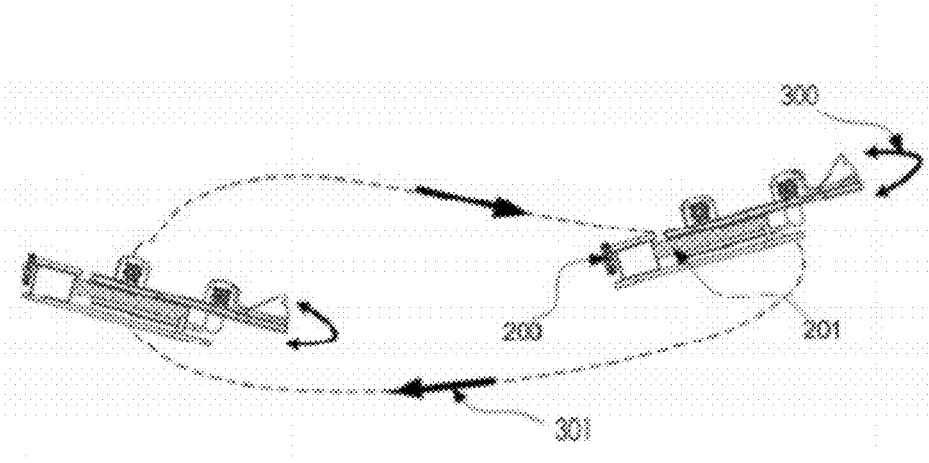

As in FIG. 2B, one end of the cable 210 is connected to the circle center of the pulley 209; the other end is connected to a linear position sensor 211. When the pulley 209 moves along the ramp 208, the length of the cable 210 changes and the linear position sensor measures the length of the change and thus the corresponding elliptical movement cycle is obtained (FIG. 2B). 0% is equivalent the highest location of the pulley in the ramp 208, and a full cycle corresponds to a gait cycle (FIG. 2B). With the recorded cycle, the measured EMG signals can be used to evaluate specific muscle activity of the lower limb. FIG. 3 shows the pivoting mechanism in elliptical training, in which the specified combined lower limb off-axis movement 300 is emphasized during the large sagittal plane (stepping/running) movement 301. An operator can observe which muscles are activated during what kind of off-axis movements and during which phase of the elliptical movement. How the slope of ramp 208 impact the lower limb muscle activity (FIG. 2B) can be evaluated. Training through combined off-axis movements such as tibial rotation and/or valgus movement during sagittal plane lower limb movements can also be done using the off-axis training apparatus.

Figure 4A:
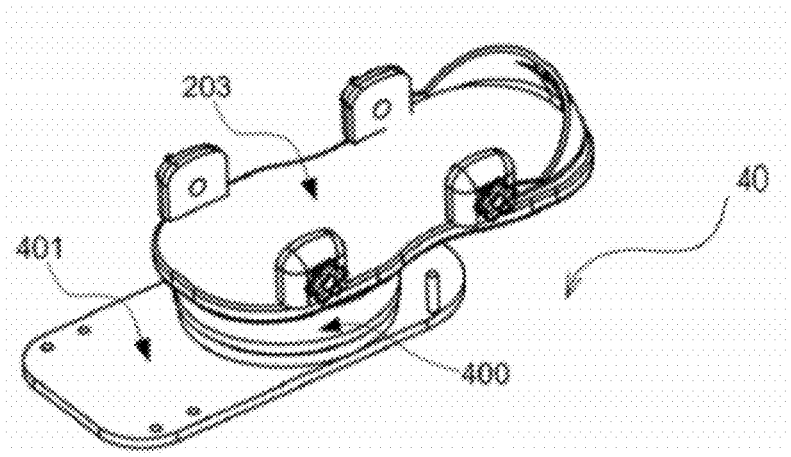
FIG. 4A is a perspective view of the 2nd mechanical structure example of the lower limb off-axis training apparatus.
Figure 4B:
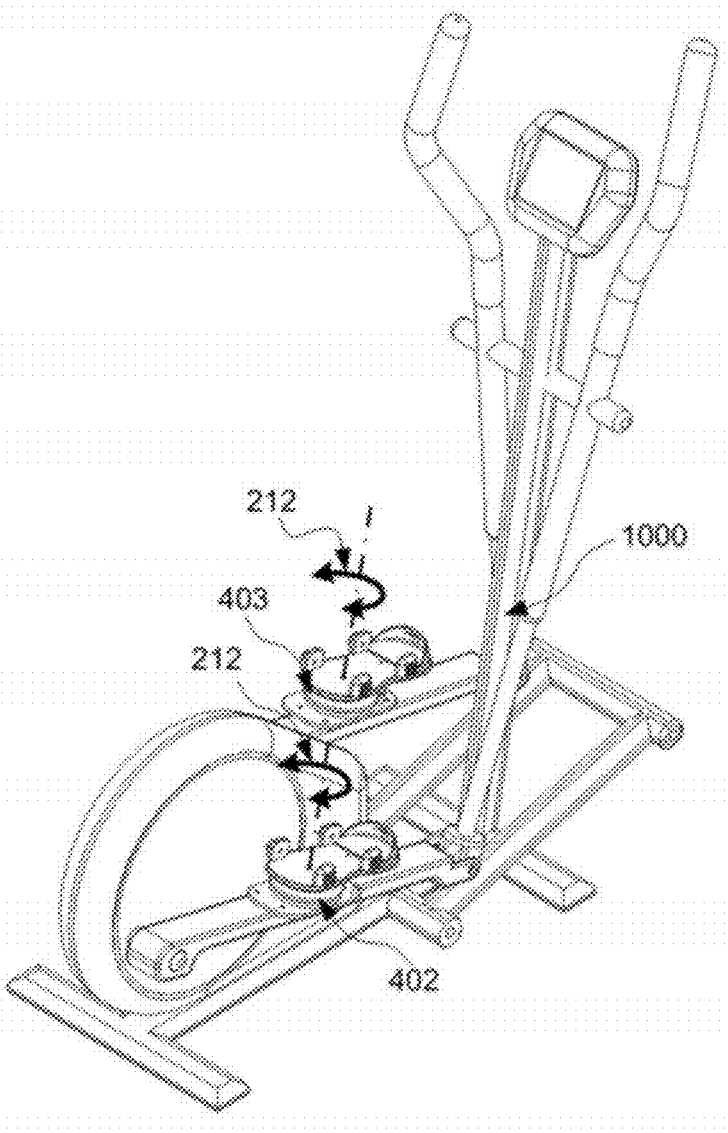
FIG. 4B is a perspective view of an elliptical machine with the lower-limb off-axis training apparatus shown in FIG. 4A.

The Second Implementation Case:

FIG. 4A and FIG. 4B illustrate a lower limbs off-axis training apparatus 40 according to the second implementation case of this invention, the difference between 40 and previous apparatus 20 is using a controlled brake (e.g. electromagnetic brake 400) to adjust resistance instead of the belt and knob mechanism in the first case. As shown in FIG. 4A, the stator of the electromagnetic brake 400 is fixed to the base 401. The rotor of 400 and the footplate 203 are fixed together. According to the working principle of electromagnetic brake: the current loaded on the electromagnetic brake 400 is proportional to the electromagnetic resistance between the rotor and the stator of 400, the rotation resistance of the footplate 203 can be adjusted by changing the current through the electromagnetic brake 400 (FIG. 4A). Users can increase the current to increase the rotation resistance of footplate 203, and also can reduce the current to reduce the rotation resistance of footplate 203. Pivoting apparatus under the control of electromagnetic brake can be combined with elliptical movement in the sagittal plane to achieve the pivoting training using elliptical machine (FIG. 4 B).

Figure 5A:
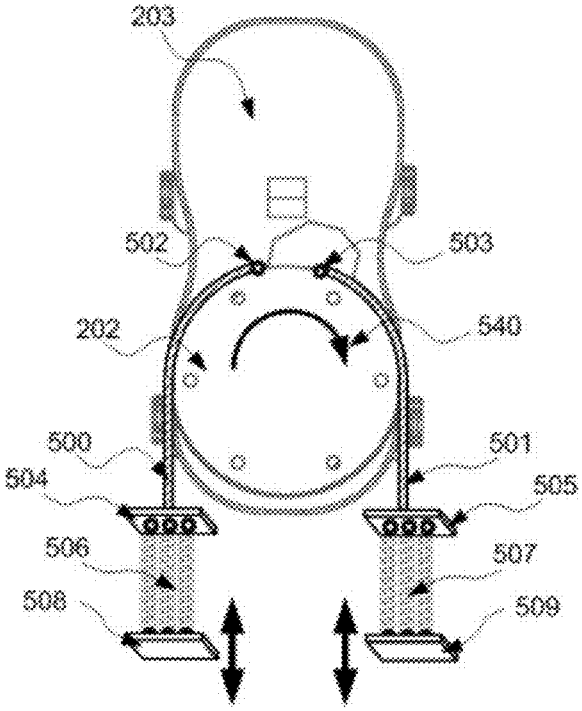
FIG. 5A is a perspective view of the 3rd mechanical structure example of the lower limb off-axis training apparatus.

The Third Implementation Case:

FIG. 5A illustrates another lower-limb off-axis training apparatus as the third implementation of this off-axis training invention. The difference between this apparatus and previous apparatuses is the resistance adjustment mechanism.

The external and internal rotation resistance of the footplate 203 and rotation disk 202 are controlled by a group of springs 506 and 507 respectively (FIG. 5A). Take the right rotation of the rotation disk 202 (in the direction of 540) as an example. 504, the front fixed end of the spring group 506, is connected to one end of cable 500, the other end of cable 500 is connected to the fixed position 502 in the rotation disk 202; the rear fixed end of the spring group 506, which is 508, is connected to adjustment mechanism 202 or motor 510. When the user's feet perform the rotation of 203 and 202 towards the 540 direction, the cable 500 will stretch the spring group 506 to elongate the spring length. The elongation will exert a force on the rotation disk 202 in the direction of impeding the rotation towards 504. Therefore, when the user tries to rotate in the 540 direction, there will be off-axis rotation resistance caused by the spring group 506. Similarly, when the user tries to rotate in the direction opposite of 540, there will be off-axis rotation resistance caused by the spring group 507. With this structure, the internal rotation resistance and external rotation resistance of footplate 203 can be adjusted respectively. In addition, after releasing the cable 500 and 501, the footplate 203 can free rotate without resistance.

The spring quantity of the spring group 506 and 507 is selectable. User can hang only one spring 520, or two springs 521, or three springs 523 (FIG. 5D) or even more. Thus the apparatus can be constructed with spring groups 506 and 507 in different stiffness thus the footplate can perform off-axis pivoting with different levels of resistance.

Figure 5B:
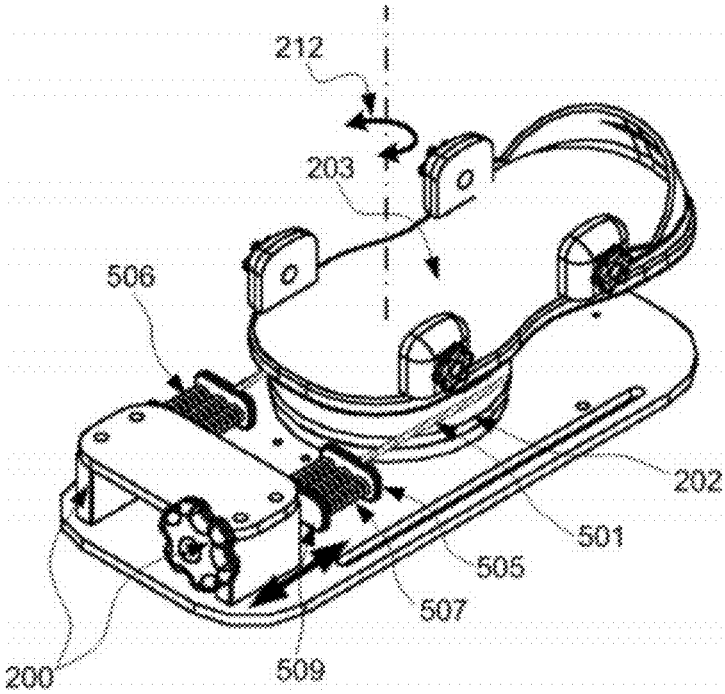
FIG. 5B is a perspective view of the lower limb off-axis training apparatus, based on the apparatus shown in FIG. 5A, using a turning knob to adjust the resistance to the pivoting movement.
Figure 8C:
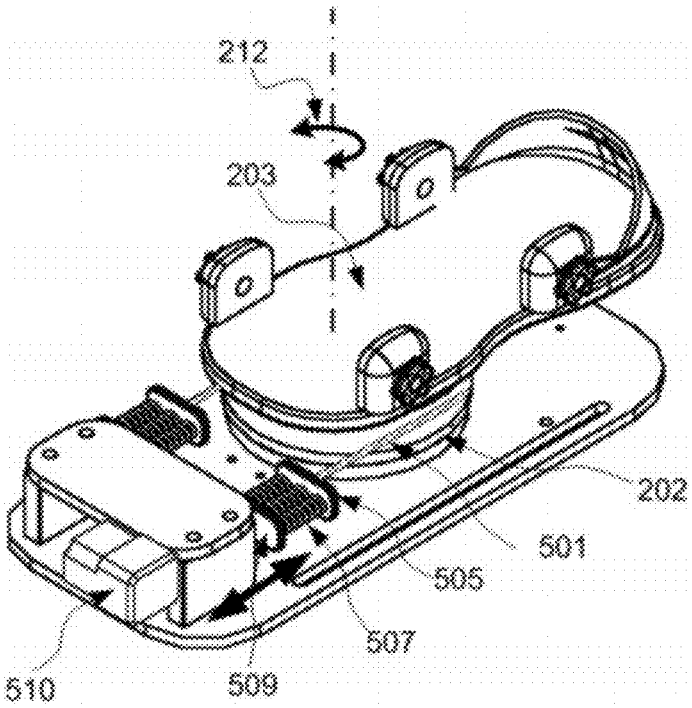
FIG. 8A, FIG. 8B is a perspective view of the 6th mechanical structure example of the lower limb off-axis training apparatus.
Figure 8D:
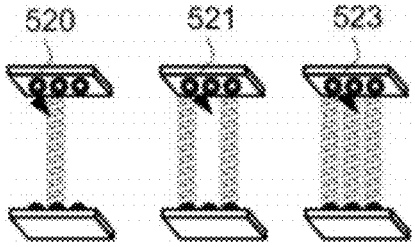

In addition, as described in FIGS. 5B and 5C, the initial tension force of spring group 506 and 507 can be adjusted by turning the knob 200 or by motor 510 through pulling the rear end of the spring group 508 and 509. As shown in FIG. 5B, the user turn the knob 200 clockwise to make the internal screws rotation, which will drive the backward slide of the nuts; and the nuts are fixed with the rear end of the spring group 508 and 509 respectively, thereby pulling 508 and 509 backward. Therefore the initial tension forces of 506 and 507 have been increased. If the user counter-clockwise rotate knob 200, the rear ends of the spring group move towards the loosen direction and the initial tension force of 506 and 507 have been reduced accordingly. With this spring group tensioning mechanism, user can achieve the resistance adjustment of the off-axis training by adjusting the initial tension force of the spring groups. As shown in FIG. 5C, the rotation function of the knob 200 can be replaced by motor 510. Motor 510, fixed to the base, implements the inside screw rotation, drives the same spring group structure to adjust the resistance electrically.

Figures 6A, 6B, 6C:
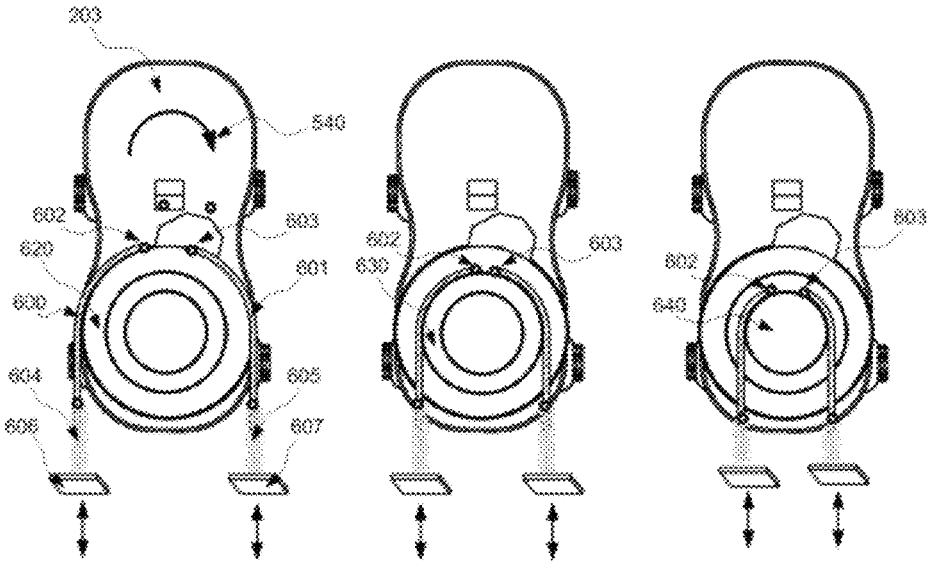
FIG. 6A, FIG. 6B and FIG. 6C is a perspective view of the 4th mechanical structure example of the lower limb off-axis training apparatus.

The Fourth Implementation Case:

FIG. 6A, FIG. 6B and FIG. 6C illustrate a lower limbs off-axis training apparatus according to the fourth implementation. The differences between this apparatus and previous apparatuses are the resistance adjustment mechanism and the rotation disk. This training apparatus consists of different concentric rotation disks with different diameters (three are shown in FIG. 6 as an example).

The internal rotation and external rotation resistance of footplate 203 are controlled by a single spring fixed in different positions. Shown in FIG. 6A, 6B, 6C, take the rotation in the 504 direction as an example, one end of cable 600 is connected to spring 604. The other end of 600 could be connected to one of the rotation disks 620,630,640 with different diameters. Instead of discrete disks with different diameters, a frustum of cone structure can be used alternatively to provide continuous change of the disk diameter. Take FIG. 6A as an example, the other end of 600 is connected to the biggest rotation disk 620 in the contact point 602. When the user's feet perform the rotation of 203 and 202 towards the 540 direction, the cable 600 will stretch the spring group 604 to elongate the spring length. At this moment, the elongation will generate a force exerted on the rotation disk 202 in the direction of impeding the rotation towards 504. Therefore, when the user tries to rotate in the 540 direction, there will be off-axis rotation resistance caused by the spring group 605. With this structure, the internal rotation resistance and external rotation resistance of footplate 203 can be adjusted individually. In addition, after releasing cable 600 and 601, footplate 203 can freely rotate without resistance.

The rotation resistance exerted on the rotation disk can be adjusted by connecting the other end of 600 to one of the rotation disks 620,630,640 with different diameters. When footplate 203 rotates an angle $\alpha$ in the 540 direction, disk 620 with largest diameter (FIG. 6A) will cause more elongation of the spring compared to that of the smaller disks, which means the larger rotation resistance in the pivoting process. Therefore, if the user needs stronger off-axis training, the end 602 or 603 can be attached to 620; otherwise the user can attach the 602 or 603 to the smaller diameter rotation disk 640.

The initial tension force of the spring 604 and 605 can be adjusted by the same pulling structure in third implementation case (FIGS. 5B and 5C). The knob 200 and motor 510 can be used to pull the rear fixed end of the spring, as indicated by 606 and 607.

Figure 7:
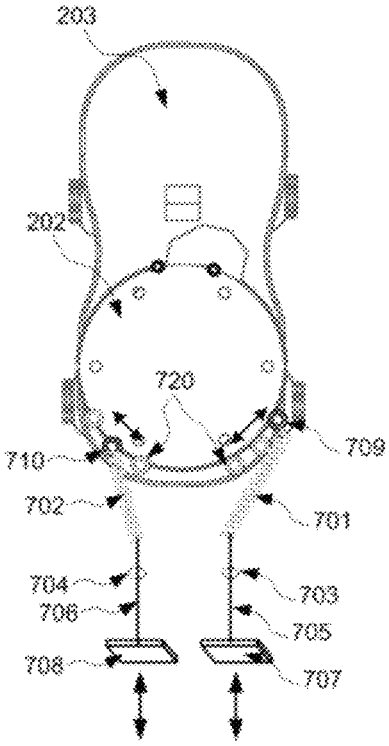
FIG. 7 is a perspective view of the 5th mechanical structure example of the lower limb off-axis training apparatus.

The Fifth Implementation Case:

FIG. 7 illustrates another lower limbs off-axis training apparatus according to the fifth implementation of this invention. The difference between this apparatus and previous apparatuses is the resistance adjustment mechanism. The external and internal rotation resistance of the footplate 203 are controlled by attaching the front end of the spring to different attachment points. As shown in FIG. 7, the spring end 702 is connected to cable 706, the other end 710 can be connected to the tension adjustment point 720, which is fixed on disk 202. The other end of cable 706 is connected to the adjustment end 708 by cable guide 704. In the other rotation direction, there is similar adjustment mechanism, such as spring 701, cable guide 703, cable 705 and adjustment end 707.

When resistance changes in rotation are needed, the user can adjust the fixed end 710 to a position 720, and adjust the fixed end 709 to another position 720. Therefore when the rotation disk 202 rotates, springs 701 and 702 have different extension lengths. The function of the cable guide 704 and 703 is to guide the sliding of cables 706 and 705 during the 202 rotation and allows the spring length adjustment. When disk 202 rotates clockwise, only spring 702 is tensioned, while spring 701 is not tensioned due to the soft cable 705. Similarly, when disk 202 rotates counter-clockwise, only spring 701 is tensioned, while spring 702 is not tensioned due to the soft cable 706. With this structure, the internal rotation resistance and external rotation resistance of footplate 203 can be adjusted independently. In addition, after releasing the cable 705 and 706, the footplate 203 can free rotate without resistance.

Figure 8A:
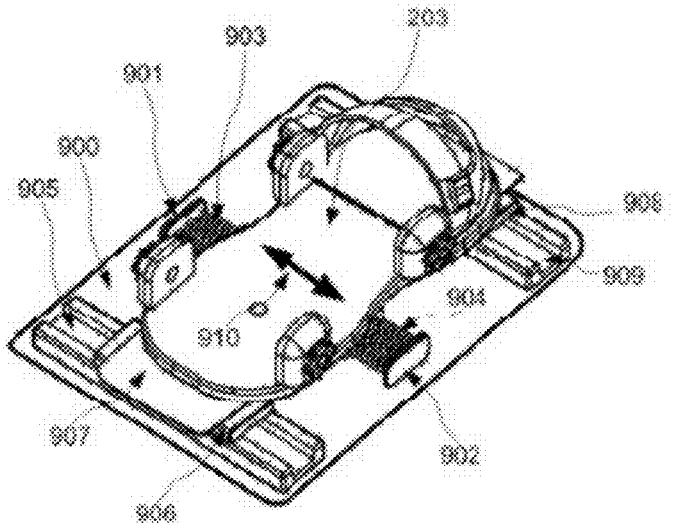
Figure 8B:
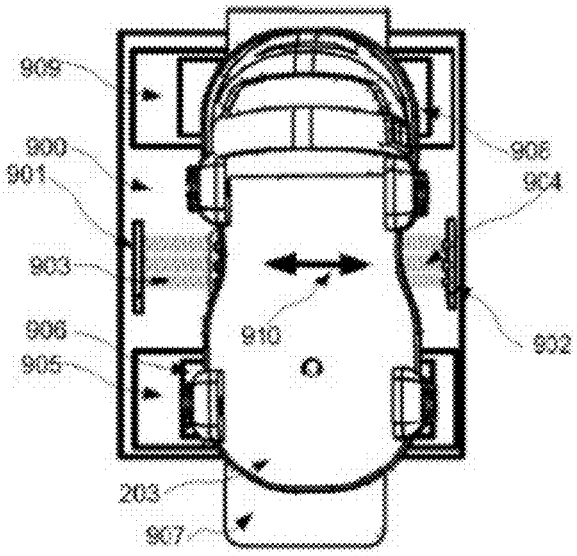

The Sixth Implementation Case:

FIG. 8A and FIG. 8B illustrate another lower limb off-axis training apparatus as the sixth implementation of this invention, which can perform off-axis lateral sliding movement of the feet along ML axis, which is associated with knee varus/valgus off-axis and ankle inversion/eversion movements.

This lower limb off-axis training apparatus is mounted on the movement part of elliptical machine through base 900. Similar to the pivoting mechanism combined with elliptical training, this apparatus can be used for lower limb mediolateral sliding training during the sagittal movements (e.g., stepping/running).

The main structure in this lower limb off-axis training apparatus includes a linear sliding mechanism (linear sliding guide 905, 909, sliding block 906, 908), spring group 903,904 and a tension adjustment board 901, 902. As shown in FIG. 8A and FIG. 8B, footplate 203 is fixed on sliding board 907; and the sliding block 908 (front) and 906 (rear) are mounted on the front and rear of the sliding board 907 underside. The two sliding blocks can mediolaterally slide on the linear guides 905 and 909 along the 910 direction (ML axis). One end of spring group 903 and 904 is attached to each side of sliding board 907 individually, the other end is fixed to the tension adjustment board 901 and 902, which are mounted on the base 900. The mounting position is adjustable so as to generate the different initial length of the spring group.

Since the two spring groups are connected to the two sides of the sliding board 907 individually, they can exert a mediolateral sliding force along ML axis to sliding board individually. When user performs lateral sliding, due to the change of the spring length, he/she will feel a spring force from footplate 203. By mounting the tension adjustment board 901 and 902 to different position, asymmetrical lateral sliding force exerted on footplate 203 can be generated.

In practical setting, both spring groups (903,904) are not necessary. we can only attach a single spring group 904 on one side of the sliding board 907 and adjust the corresponding adjustment board to get a symmetrical mediolaterally sliding force on footplate 203. Once there is no spring group attached, the footplate 203 can perform a free sliding movement due to the absence of lateral sliding resistance.

The number of springs of the spring group 903 and 904 is configurable. As shown in FIG. 5D, User can connect the different number of springs between the tension adjustment board 901, 902, such as only one spring 520, or two springs 521, or three springs 523 (FIG. 5D) or even more). In this way, the apparatus can be reconstructed with new spring groups 903 and 904 which have different stiffness coefficient. Therefore, the footplate can exert an off-axis mediolateral sliding with different resistance coefficient on the low limb.

In addition, the apparatuses in the previous implementation cases used for control the pivoting stiffness of the internal and external rotation can also be used for controlling the lateral sliding tightness. For example, the medial and lateral sliding tightness of the footplate could be controlled and adjusted by the springs mounted on the medial and lateral sides of the footplate. The springs on the two sides can be either symmetric or asymmetric, which depends on the target direction in the training process.

Based on this invention, there are various alternatives based on the above implementations by further improvements and different combinations. For example, we can implement a combination of off-axis pivoting about the PD axis and the off-axis sliding movement along the ML axis. By mounting the mediolateral sliding mechanism on the base, and then mounting the pivoting base on said mediolateral sliding mechanism, and then mounting the pivoting mechanism on the pivoting base (such as a rotating disk or an electromagnetic brake), we can implement the combined pivoting-sliding mechanism. Of course the mounting order could be also first the pivoting mechanism, then the sliding base, then the sliding mechanism. Another example, in the previous cases we use the extension of the spring to generate resistance; instead we also could use the compression of the spring. And another example, we could use motor to drive the pivoting mechanism or sliding mechanism to generate the off-axis pivoting and off-axis sliding movement to achieve more effective training outcome.

Usage of the Lower Limb Off-Axis Movement Training Apparatus

Considering that the lower limbs are free to move in the sagittal plane (e.g., knee flexion/extension, ankle dorsi-/plantar flexion), musculoskeletal injuries generally do not occur in sagittal plane movements. On the other hand, joint motion about the minor axes (or called off-axes) (e.g., knee valgus/varus (synonymous with abduction/adduction), tibial rotation, ankle inversion/eversion and internal/external rotation) is much more limited and musculoskeletal injuries are usually associated with excessive loading/movement about the minor axes. It is therefore critical to improve neuromuscular control of off-axis motions (e.g., tibial rotation/valgus at the knee) in order to reduce/prevent musculoskeletal injuries.

While performing the elliptical stepping/running, the user's feet stand on the footplate of this invented combined off-axis training apparatus. The rotation resistance of this combined off-axis can be adjusted according to the training mode and individual needs.

The first use: off-axis rotation function is locked (rotation resistance is infinite). Movement under this mode is equivalent to the traditional elliptical treadmill training. User is only involved in lower extremity movement in the sagittal plane, and their off-axis rotation performance is not trained. Such a movement can be used during the warm-up and the ending relaxation period of the movement training.

The second use: In the aid of rotational resistance to maintain the stability of lower limb about the off-axis rotation. Under this condition, the lower limb can implement off-axis rotation during the elliptical movement in the sagittal plane. User needs to control the swing (disturbance) movement about the off-axis rotation. More accurately, user needs to control the stability of the footplate 203 in the off-axis rotation direction. Otherwise, the lower limb movement in the sagittal plane can be affected. The chosen rotation resistance will help improve stability of the lower limb and reduce the swing amplitude (disturbance) about the off-axis direction. The smaller the rotation resistance is, the more difficult to maintain stability and achieve the training effect about the off-axis direction.

The third use: in the absence of resistance, under the free rotation condition to maintain the stability of the lower limb about the off-axis rotation direction. Under this movement condition, lower limb can rotate freely about the off-axis direction during the sagittal plane elliptical movement. Higher requirement to control the swing (disturbance) movement about the off-axis direction is needed. More accurately, the user needs to control the stability of the footplate 203 about the off-axis rotation direction. Compared to the second use, this is more demanding to achieve the lower limb training.

The fourth use: to overcome the asymmetric (eccentric) rotation force to maintain the stability of lower limb rotation about the off-axis direction. Off-axis rotational device can generate an asymmetric (eccentric) rotation force. For example, the off-axis rotational device generate an internal rotation force, if the user does not fight against the force, the lower limb will be rotated into internal rotation, thus affecting the normal lower extremity movement in the sagittal plane. Therefore, under such conditions of movements, users are required to externally rotate the lower limb to overcome the inward rotation force, in order to remain proper lower limb posture during large sagittal movements.

Compared to the exiting apparatus which provides lower limb training in a seated posture, the design of this apparatus is characterized by the relative movement between the lower limbs and feet in the sagittal plane. This off-axis movement is concurrent with the sagittal plane movement. And the movements of the left and right sides of the lower limbs can be either relatively independent or closely related (such as movement in an elliptical machine).

Components and Individual Function of the Off-Axis Movement Training System

Figure 9:
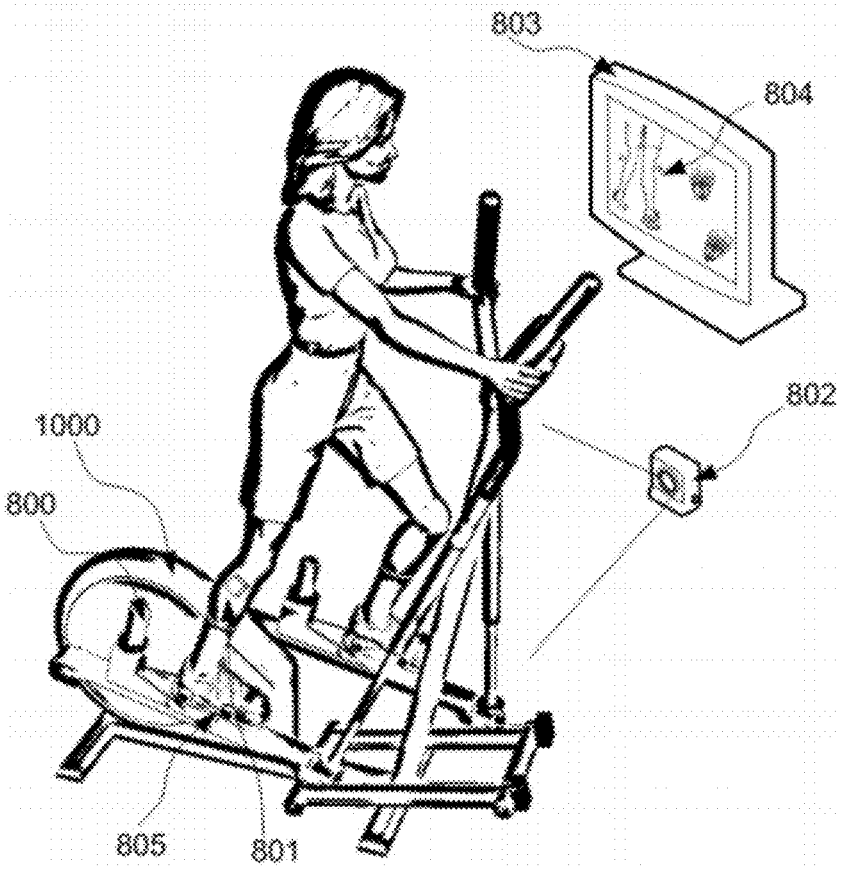
FIG. 9 An illustration of the lower limb off-axis training and feedback system based on this invention.

Based on the invented off-axis movement training apparatus, we proposed an off-axis movement training and evaluation system for lower limbs. As shown in FIG. 9, this system consists of a platform 1000 for the lower limb sagittal plane functional movement, an additional off-axis movement training apparatus 805, a camera 802 and a mechatronic device to record the user's lower limbs movement information and a display device 803 for displaying the recorded movement information.

When performing lower limb movement in the sagittal plane, user needs to control the movement about the off-axes. Real-time feedback of the footplate 203 position, measured by the position sensor 800, will be used to update a virtual reality display of the feet to help the subject achieve proper foot positioning (FIG. 9). A camera 802 can be used to capture the lower limb posture, which can be displayed in displaying device 803 to provide real-time feedback to the subject to align the lower limbs properly (e.g., knee cap over the 2nd toe). The measured footplate rotation 804 is closely related to the pivoting movements. However, if tibial rotation and/or valgus angles need to be monitored more accurately, a knee goniometer 801 can be used to measure 6-DOF knee kinematics.

Among the muscles crossing the knee, the hamstrings and gastrocnemius muscles have strong off-axis actions in controlling tibial rotation about the PD axis and valgus/varus about the AP axis. Therefore, they are expected to get strengthened through the off-axis pivoting elliptical training. Specifically, lateral hamstring and medial gastrocnemius muscles have significant off-axis action in external tibial rotation. So if control in external tibial rotation needs to be improved based on a subject-specific diagnosis, these muscles will be targeted for strengthening. If needed, real-time feedback from the EMG signals of these muscles can be used. On the other hand, the medial hamstring and lateral gastrocnemius muscles will be targeted in particular if control in internal tibial rotation needs to be improved. Of note is that for more precise control, both agonist and antagonist muscles may be involved. Therefore, both medial and lateral hamstrings and both medial and lateral gastrocnemius muscles will need to be trained but with the medial and lateral sides strengthened to different degrees and controlled synchronously. Hip abductors and external rotators (e.g., gluteus maximus and gluteus medius) control multi-axis movements of the proximal femur and contribute to the overall knee stability in pivoting and valgus/varus motions. If needed, these hip muscles can be targeted in the pivoting and/or sliding elliptical training through real-time biofeedback to control/stabilize the femur, which helps improve neuromuscular control of the lower limb including the knee (FIG. 9). Overall, the difficulty of the combined movement (off-axis and sagittal plane movement) training starts from moderate level and increase to a higher level, within the subject's comfort limit. The subjects are encouraged to exercise at the level of strong tibial rotation stiffness. The off-axis stiffness or off-axis perturbations provided by the off-axis training apparatus can be adjusted within pre-specified ranges for easier training. If needed, a shoulder-chest harness can be used to insure subject safety.

What is claimed:

1. A lower-limb off-axis training apparatus, which is mounted on the movement part of a sagittal plane exercise machine and allows the user to preform off-axis movement training during sagittal plane movements; Said lower limb off-axis training apparatus comprising a base;

an off-axis resistance generating part mounted on said base;

a foot container supported by said off-axis resistance generating part;

Said off-axis resistance generating part comprising at least one of the following:

(1) off-axis pivoting resistance generating part, which exerts pivoting resistance on said foot container about the defined PD axis;

Wherein said off-axis pivoting resistance generating part comprising:

a rotation disk, said rotation disk is attached on said foot container;

a first spring group and a second spring group, said first spring group and second spring group are attached on each side of said rotation disk and exert adjustable resistance force on said rotation disk about the defined PD axis;

a pair of cables, said pair of cables link said first spring group and second spring group to said rotation disk respectively;

an initial tension adjustment means, wherein said adjustment means drives said spring group and elongates the spring length;

wherein, one end of said cable is connected to the front fixed end of said spring group; the other end of said cable is connected to the fixed position on said rotation disk; the rear fixed end of said spring group is connected to said adjustment part; the initial tension force of said spring group is adjusted by pulling said rear end of said spring group through said adjustment means;

(2) off-axis sliding resistance generating part, which exerts sliding resistance on said foot container along the defined ML axis;

Wherein said off-axis sliding resistance generating part comprising:

a front linear sliding pair and a rear linear sliding pair, each said linear sliding pair includes at least one linear sliding guide and at least one sliding block;

a sliding board, said sliding board is mounted on the top of said front and rear sliding blocks;

a first spring group and a second spring group, one end of said first spring group and second spring group is attached to each side of said sliding board individually and exerts adjustable resistance along the defined ML axis;

a pair of mediolateral tension adjustment boards, said board is mounted on the said base and connected to the other end of said first spring group and second spring group;

wherein the mounting position of said pair of boards is adjustable on said base to get asymmetrical lateral sliding force exerted on said sliding board by changing different initial length of said first spring group and second spring group.

2. The off-axis training apparatus of claim 1 wherein said initial tension adjustment means further comprising a motor or a knob, wherein said motor or knob drives said rear fixed end of said spring group to adjust initial tension force of said spring groups.

3. The off-axis training apparatus of claim 1 wherein said rotation disk further comprising multiple concentric circular disks with different diameters, wherein each end of said pair of cables of claim 1 is attached to said different diameter of concentric circular disks in order to adjust different elongation of said first and second spring group.

4. The off-axis training apparatus of claim 1 wherein said rotation disk further comprising one or more attachment points, wherein the fixed end of said spring groups is attached to said different attachment points in order to adjust the different spring extension length.

5. The off-axis training apparatus of claim 1 wherein said first and second spring groups of said off-axis pivoting resistance generating part further comprising one or more spring units, wherein said different spring combination generates different pivoting resistance with different stiffness coefficient.

6. The off-axis training apparatus of claim 1 wherein said first and second spring groups of said off-axis sliding resistance generating part comprising one or more spring units, wherein said different spring combination generates different mediolateral sliding resistance with different stiffness coefficient.

7. The off-axis training apparatus of claim 1 wherein said off-axis resistance generating part further comprises a first mount on a left side of said sagittal plane exercise machine and a second mount on a right side of said sagittal plane exercise machine.

8. The off-axis training apparatus of claim 1, further comprising a knee goniometer to record knee kinetic and kinematic movement information of the lower limbs.

9. The off-axis training apparatus of claim 1, further comprising a camera and a displaying device, wherein said camera captures the lower limb posture and said displaying device displays captured qualitative feedback for the user to align the lower limbs properly.

10. The off-axis training apparatus of claim 1, further comprising a shoulder-chest harness to insure subject safety.

* * * * *